US010357057B2

(12) United States Patent
Kadiric

(10) Patent No.: US 10,357,057 B2
(45) **Date of Patent: *Jul. 23, 2019**

(54) SMOKING ARTICLE WITH MOUTH END CAVITY

(71) Applicant: PHILIP MORRIS PRODUCTS S.A., Neuchatel (CH)

(72) Inventor: Alen Kadiric, Biel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/417,452

(22) PCT Filed: Jul. 19, 2013

(86) PCT No.: PCT/EP2013/065339

§ 371 (c)(1),
(2) Date: Jan. 26, 2015

(87) PCT Pub. No.: WO2014/023557

PCT Pub. Date: Feb. 13, 2014

(65) Prior Publication Data

US 2015/0208722 A1 Jul. 30, 2015

(30) Foreign Application Priority Data

Aug. 6, 2012 (EP) ..... 12179437

(51) Int. Cl.
*A24D 3/06* (2006.01)
*A24C 5/47* (2006.01)
(Continued)

(52) U.S. Cl.
CPC ..... *A24D 3/061* (2013.01); *A24C 5/476* (2013.01); *A24D 1/002* (2013.01); *A24D 1/045* (2013.01);
(Continued)

(58) Field of Classification Search
CPC .... A24D 3/061; A24D 3/0291; A24D 3/0216; A24D 3/02; A24D 3/00; A24D 3/04;
(Continued)

(56) References Cited

U.S. PATENT DOCUMENTS 4,243,053 A * 1/1981 Cartwright ..... A24D 1/10 131/331
7,243,659 B1 * 7/2007 Lecoultre ..... A24C 5/476 131/331
(Continued)

FOREIGN PATENT DOCUMENTS

EA 004280 2/2004
EA 200870378 8/2009
(Continued)

OTHER PUBLICATIONS

PCT Search Report and Written Opinion for PCT/EP2013/065339 dated Jan. 20, 2014 (12 pages).
(Continued)

*Primary Examiner* — Michael H. Wilson
*Assistant Examiner* — Yana B Krinker
(74) *Attorney, Agent, or Firm* — Mueting, Raasch & Gebhardt, P.A.

(57) ABSTRACT

A smoking article (10) comprises a tobacco rod (12) and a filter (14) connected to the tobacco rod (12). The filter (14) comprises a first filter segment (18, 20) comprising one or more breakable capsules, wherein each breakable capsule comprises an outer shell and an inner core containing an additive. The filter (14) further comprises a hollow tube segment (22) downstream of the first filter segment (18, 20) and positioned between a downstream end of the first filter segment (18, 20) and the mouth end of the filter (14). The hollow tube segment (22) defines a cavity (24) at the mouth end of the filter (14). A plug wrap (23) circumscribes the first
(Continued)

filter segment (18, 20) and the hollow tube segment (22), wherein the plug wrap (23) has a basis weight of less than 90 grams per square meter.

13 Claims, 3 Drawing Sheets

(51) Int. Cl.
*A24D 3/02* (2006.01)
*A24D 3/04* (2006.01)
*A24D 1/00* (2006.01)
*A24D 1/04* (2006.01)

(52) U.S. Cl.
CPC ..... *A24D 3/0291* (2013.01); *A24D 3/04* (2013.01); *A24D 3/048* (2013.01)

(58) Field of Classification Search
CPC ..... A24D 3/048; A24D 1/002; A24D 1/045; A24C 5/476
See application file for complete search history.

(56) References Cited

U.S. PATENT DOCUMENTS

| | | | | |
|---|---|---|---|---|
| 7,878,963 | B2 | 2/2011 | Li | |
| 8,235,057 | B2 | 8/2012 | Li | |
| 8,820,331 | B2 | 9/2014 | Hartmann | |
| 9,060,546 | B2 | 6/2015 | Li | |
| 9,339,060 | B2 | 5/2016 | Hartmann | |
| 2007/0012327 | A1* | 1/2007 | Karles | A24D 3/0216 131/337 |
| 2008/0142028 | A1 | 6/2008 | Fagg | |
| 2008/0216851 | A1 | 9/2008 | Olegario | |
| 2008/0216853 | A1 | 9/2008 | Li | |
| 2010/0242977 | A1* | 9/2010 | Tarora | A24D 1/02 131/275 |
| 2013/0104915 | A1 | 5/2013 | Eitzinger | |

FOREIGN PATENT DOCUMENTS

| | | |
|---|---|---|
| EA | 200970842 | 2/2010 |
| EP | 1 872 673 | 1/2008 |
| EP | 2229827 | 9/2010 |
| GB | 453172 | 9/1936 |
| GB | 862 676 | 3/1961 |
| GB | 2203324 | 10/1988 |
| GB | 2210546 | 6/1989 |
| JP | H07-83701 | 9/1995 |
| JP | 08-322538 | 12/1996 |
| JP | 2004-516814 | 6/2004 |
| RU | 2162652 | 2/2001 |
| RU | 2415618 | 4/2011 |
| WO | WO 2002/003819 | 1/2002 |
| WO | WO 2007/110650 | 10/2007 |
| WO | WO 2011/077141 | 6/2011 |
| WO | WO 2011/118023 | 9/2011 |
| WO | WO 2011/120687 | 10/2011 |

OTHER PUBLICATIONS

Office Action issued in China for Application No. 201380041689.6 dated Jul. 21, 2016 (15 pages). English translation included.
European Extended Search Report for Application No. 12179437.4-1656 dated Feb. 27, 2013 (6 pages).
Office Action issued in Australia for Application No. 2013301770 dated Apr. 15, 2016 (5 pages).
Office Action issued in Japan for Application No. 2015-525806 dated Apr. 12, 2017 (6 pages). English translation included.
Office Action issued in Kazakhstan for Application No. 2015/0251.1 dated Sep. 22, 2016 (16 pages). English translation included.
Office Action issued in Japan for Application No. 2015-525806 dated Feb. 21, 2018 (8 pages). English translation included.
Office Action issued in Taiwan for Application No. 102127437 dated Aug. 9, 2017 (15 pages). English translation included.

* cited by examiner

SMOKING ARTICLE WITH MOUTH END CAVITY

This application is a U.S. National Stage Application of International Application No. PCT/EP2013/065339, filed Jul. 19, 2013, which was published in English on Feb. 13, 2014 as International Patent Publication WO 2014/023557 A1. International Application No. PCT/EP2013/065339 claims priority to European Application No. 12179437.4, filed Aug. 6, 2012.

The present invention relates to a smoking article having a mouth end cavity defined by a hollow tube segment.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the smoking article. As the released compounds cool they condense to form an aerosol that is inhaled by the consumer. Smoking articles in which a nicotine-containing aerosol is generated from a tobacco material, tobacco extract or other nicotine source, without combustion or heating, are also known.

Sometimes it is desirable to provide the filter section of a smoking article with a cavity at the mouth end. However, such mouth end cavities are prone to collapse or deformation during manufacture of the smoking article and during subsequent handling by the consumer, particularly when the filtration material includes one or more breakable flavour containing capsules which must be ruptured by squeezing the filter prior to smoking.

It would therefore be desirable to provide a smoking article having a mouth end cavity which is resistant to collapse.

According to a first aspect, the present invention provides a smoking article comprising a tobacco rod and a filter connected to the tobacco rod. The filter comprises a first filter segment comprising one or more breakable capsules, wherein each breakable capsule comprises an outer shell and an inner core containing an additive. The filter further comprises a hollow tube segment downstream of the first filter segment, the tube segment positioned between a downstream end of the first filter segment and the mouth end of the filter. The hollow tube segment defines a cavity at the mouth end of the filter. A plug wrap circumscribes the first filter segment and the hollow tube segment, wherein the plug wrap has a basis weight of less than 90 grams per square metre.

In some embodiments, the hollow tube segment extends from the downstream end of the first filter segment to the mouth end edge of the filter.

As used herein, the terms "upstream" and "downstream" are used to describe the relative positions of elements, or portions of elements, of the smoking article in relation to the direction in which a user draws on the smoking article during use thereof. Smoking articles as described herein comprise a downstream end and an opposed upstream end. In use, a user draws on the downstream end of the smoking article. The downstream end, which is also described as the mouth end, is downstream of the upstream end, which may also be described as the distal end.

By forming a mouth end cavity with a hollow tube segment, the present invention advantageously provides a smoking article having a mouth end cavity with improved resistance to collapse or deformation. Such resistance to collapse or deformation can advantageously eliminate the need to use stiff, high basis weight plug wraps and tipping wrappers which might otherwise be required to prevent collapse of the mouth end cavity. Such high basis weight plug wraps and tipping wrappers are undesirable since they can become creased or folded during manufacture of the smoking article, and they can also add other costly steps to the manufacturing process such as the need for online laser perforation ventilation. Furthermore, high basis weight plug wraps and tipping wrappers can make it difficult for a consumer to deform the filter in order to break the one or more capsules contained therein. By eliminating the need for such high basis weight plug wraps and tipping wrappers and by forming the mouth end cavity using a hollow tube segment, smoking articles in accordance with the present invention allow a consumer to easily deform the filter at the first filter segment in order to break the one or more capsules contained therein, whilst ensuring the mouth end cavity is sufficiently resistant to deformation or collapse.

Since smoking article filters are generally circular in cross section, the resistance of the hollow tube segment to collapse or deformation may be such that the ovality of the hollow tube segment after a 50% deformation of the filter is less than 25%, preferably less than about 20%. In this case, the mouth end cavity of the smoking articles will retain or resume a generally circular cross section, even after a 50% deformation of the filter. The particular test procedure for conducting deformations of the filter in accordance with present invention is described in detail below.

The term "ovality" as used herein means the degree of deviation from a perfect circle. Ovality is expressed as a percentage and the mathematical definition is given below.

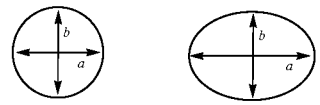

Circular shape $a = b$ Oval shape $a \neq b$ $$\text{ovality (\%)} = \frac{2(a - b)}{a + b} \times 100\%$$

To determine the ovality of a segment of a smoking article (such as a hollow tube segment) in accordance with the present invention, the mouth end is viewed along the longitudinal direction of the smoking article. For example, the smoking article can be positioned on its mouth end on a transparent stage so that an image of the mouth end of the article is recorded by a suitable imaging device located below the stage. Dimension "a" is taken to be the largest external diameter of the segment at its downstream end and dimension "b" is taken to be the smallest external diameter of the segment at its downstream end. The process is repeated for a total of ten smoking articles having the same design and the number average of the ten ovality measurements is recorded as the ovality for that design of smoking article.

As described above, the resistance of the hollow tube segment to collapse or deformation may be such that the ovality of the hollow tube segment after a 50% deformation of the filter is less than 25%, preferably less than about 20%. This is itself a novel and inventive arrangement, and so according to a second aspect the present invention provides a smoking article comprising a tobacco rod and a filter connected to the tobacco rod. The filter comprises a first filter segment and a hollow tube segment downstream of the first filter segment, the tube segment positioned between a downstream end of the first filter segment and the mouth end of the filter. The ovality of the hollow tube segment after a 50% deformation of the filter is less than 25%, preferably less than about 20%.

In some embodiments, the hollow tube segment extends from the downstream end of the first filter segment to the mouth end edge of the filter.

The resistance of the hollow tube segment to collapse or deformation may also be such that the ovality of the tube segment after a 67% deformation of the filter is preferably less than about 35%, more preferably less than about 30%, for smoking articles in accordance with both aspects of the present invention. Additionally, or alternatively, the resistance of the hollow tube segment to collapse or deformation may be such that the difference between the ovality of the tube segment after 50% deformation of the filter and the ovality of the tube segment prior to deformation is less than about 25%, preferably less than about 20%. For example, where the ovality of the tube segment prior to deformation is 5%, the ovality of the tube segment after a 50% deformation of the filter is preferably less than 30%, more preferably less than 25%.

In some embodiments, the ovality of the hollow tube segment after a 50% deformation of the filter performed after the smoking article has been subjected to a smoking test is preferably less than about 35%, more preferably less than about 30%. Alternatively, or in addition, the ovality of the tube segment after a 67% deformation of the filter performed after the smoking article has been subjected to a smoking test is preferably less than about 45%, more preferably less than about 40%. This advantageously provides consistency in the ovality of the mouth end cavity during smoking of smoking articles in accordance with both aspects of the present invention.

The smoking test used for testing smoking articles in accordance with both aspects of the present invention is described in detail below. Where it is necessary to measure the ovality after deformation tests performed both before and after smoking, two samples of smoking articles having the same design should be used. That is, a non-deformed un-smoked smoking article should be used for the pre-smoking deformation test, and non-deformed articles having the same design are subjected to the smoking test and used for the post-smoking deformation test.

In some embodiments of the invention according to both aspects, the hollow tube segment may be formed from a polymeric material or a paper material. For example, the hollow tube segment can be formed from an extruded plastic tube. Preferably, the hollow tube segment is formed from a plurality of overlapping paper layers, such as a plurality of parallel wound paper layers or a plurality of spirally wound paper layers. Forming the hollow tube segment from a plurality of overlapping paper layers can help to further improve resistance to collapse or deformation. Preferably each hollow tube segment comprises at least two paper layers. Alternatively, or additionally, each hollow tube segment preferably comprises fewer than eleven paper layers.

An exemplary method for forming a tube segment from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel.

One factor that may restrict the ability of the hollow tube segment to retain its ovality during smoking of the smoking article is absorption of moisture into the tube segment during smoking. Therefore, to inhibit the transfer of moisture from one paper layer to the next during smoking of the smoking article, adjacent paper layers of each tubular member are preferably adhered together by an intermediate layer of adhesive, which provides a barrier to the transfer of moisture between layers. Additionally, or alternatively, the hollow tube segment may comprise a coating layer on an inner surface thereof, which can inhibit absorption of moisture into the hollow tube segment. In those embodiments in which the hollow tube segment is formed from a plurality of paper layers, a coating layer may additionally or alternatively be provided between some or all of the adjacent paper layers. Suitable coating materials include, but are not limited to, waxes, polymeric materials and combinations thereof. Particularly suitable waxes include vegetable waxes, and other particularly suitable materials are ethylcellulose and nitrocellulose.

To increase the resistance of the hollow tube segment to crushing, the filter preferably has an un-smoked compressive strength of at least about 20 Newtons at 50% compression. Alternatively, or in addition, the un-smoked compressive strength of the filter at 50% compression is preferably less than about 50 Newtons. The term "compressive strength" is a measure of the force required to provide a particular compression of the filter section of the smoking article. Compressive strength is measured using the compressive strength test described in detail below, where the compressive strength of a given smoking article design is the number average of the compressive strength measurements for a sample of ten smoking articles having the same design.

To assist in providing the required resiliency and resistance to deformation or crushing, the hollow tube segment preferably has a wall thickness of at least about 100 micrometres, more preferably at least about 150 micrometres. Alternatively, or in addition, the wall thickness is preferably less than about 500 micrometres, more preferably less than about 350 micrometres, most preferably less than about 250 micrometres.

The hollow tube segment preferably extends at least about 2 mm from the downstream end of the first filter segment in the finished cigarette. This not only provides a mouth end cavity of an appropriate size, but also ensures sufficient overlap between the hollow tube segment and any wrapper which may circumscribe the tube segment to maintain it in axial alignment with the filter segment. Such wrappers include plug wraps and tipping wrappers. Additionally, or alternatively, the hollow tube segment preferably extends no more than about 15 mm from the downstream end of the first filter segment.

In some embodiments of the invention according to the second aspect, it may be desirable to provide the filter with means for releasing a flavourant or other additive on demand, usually via manual release by the consumer immediately prior to smoking the article. Therefore, the filter may comprise at least one filter segment including a flavourant containing material, such as one or more breakable capsules comprising an outer shell and an inner core containing an additive. Preferably the at least one filter segment comprises one or more breakable capsules dispersed within a fibrous filtration material. The at least one filter segment may be the first filter segment, or an additional filter segment which may be incorporated into the filter, or a combination thereof.

Similarly, the additive contained within the one or more breakable capsules of smoking articles in accordance with the first aspect of the present invention may include a flavourant.

In embodiments comprising a flavourant containing material, in accordance with both aspect of the present invention, the at least one flavour containing filter segment is preferably circumscribed by a plug wrap that is substantially impermeable to the flavourant additive. This advantageously inhibits transfer of the additive through the plug wrap to the outside of the smoking article, where it may undesirably come into contact with the consumer's fingers and may tarnish the appearance of the smoking article.

Where the at least one flavour containing filter segment comprises one or more breakable capsules, the ovality of the tube segment is preferably less than 35%, more preferably less than 30%, after a capsule crush test in which a force corresponding to the crush strength of the one or more capsules is applied to the smoking article. The crush strength of a capsule corresponds to the compressive force required to break open the capsule and release the additive contained within the capsule when the capsule is disposed within the filter segment. The capsule crush test is described in detail below.

Where the capsule crush test is performed after the smoking article has been subjected to a smoking test, the ovality of the tube segment is preferably less than about 45%, more preferably less than about 40%, after the capsule crush test.

As mentioned above, smoking articles according to both aspects of the present invention may comprise additional filter segments in combination with the first filter segment. For example, in one embodiment, the smoking article further comprises a rod end segment between the first filter segment and the tobacco rod.

The filtration material within each filter segment of the smoking article is preferably a plug of fibrous filtration material, such as cellulose acetate tow or paper. A filter plasticiser may be applied to the fibrous filtration material in a conventional manner, by spraying it onto the separated fibres, preferably before applying any additional material to the filtration material. Smoking articles according to both aspects of the present invention may also include a variety of different types of filter segments or combinations of filter segments that would be known to the skilled person, including restrictors and segments that are used for adjusting the resistance to draw (RTD). Alternatively, or in addition, smoking articles in accordance with both aspects of the present invention may include one or more segments containing carbon, preferably a rod end segment containing carbon.

To connect the hollow tube segment to the first filter segment and any other filter segments which may be present, the smoking article may comprise a combining plug wrap which circumscribes the various segments of the filter. The combining plug wrap may have a basis weight of less than about 90 gsm, preferably less than about 60 gsm, more preferably less than about 40 gsm. The combining plug wrap preferably has a basis weight of more than about 20 gsm.

The smoking article may include a tipping wrapper circumscribing the filter and at least a portion of the tobacco rod so as to connect the filter to the tobacco rod. The tipping wrapper may comprise paper having a basis weight of less than about 70 gsm, preferably less than about 50 gsm. The tipping wrapper preferably has a basis weight of more than about 20 gsm.

Smoking articles according to both aspects of the present invention may be filter cigarettes or other smoking articles in which the tobacco material is combusted to form smoke. Alternatively, smoking articles according to both aspects of the present invention may be articles in which the tobacco material is heated to form an aerosol, rather than combusted. In one type of heated smoking article, the tobacco material is heated by one or more electrical heating elements to produce an aerosol. In another type of heated smoking article, an aerosol is produced by the transfer of heat from a combustible or chemical heat source to a physically separate tobacco material, which may be located within, around or downstream of the heat source. Both aspects of the present invention further encompass smoking articles in which a nicotine-containing aerosol is generated from a tobacco material without combustion or heating.

The present invention also provides a method of forming smoking articles, the method comprising a first step of providing a continuous array of first filter members and tubular members, wherein a tubular member is provided between each pair of consecutive first filter members. The first filter members each comprise one or more breakable capsules, each breakable capsule comprising an outer shell and an inner core containing an additive The continuous array of first filter members and tubular members is then wrapped with a continuous sheet of plug wrap to form a wrapped filter array. The plug wrap has a basis weight of less than 90 gsm. Next, the wrapped filter array is cut at an intermediate position along each of the first filter members to provide multiple filter rods, each filter rod comprising two first filter segments and a tubular member positioned between the first filter segments. A tobacco rod is then provided in axial alignment with and adjacent to each first filter segment of each filter rod, and the filter rod and a portion of each tobacco rod are wrapped in a tipping wrapper. Finally, the tipping wrapper and the filter rod are cut at an intermediate position along the length of the tubular member to form two smoking articles, each smoking article comprising a tobacco rod connected to a filter. Each filter comprises a first filter segment and a hollow tube segment positioned between the adjacent filter segment and the mouth end of the filter, the hollow tube segment defining a cavity at the mouth end of the filter.

Test Procedures

Deformation and Compressive Strength Test

The smoking article to be tested is positioned between a flat surface and a circular plate opposed to the flat surface, the circular plate having a diameter of 10 mm. The edge of the circular plate closest to the mouth end of the smoking article is positioned 8 mm from the mouth end. The filter is then compressed by moving the circular plate towards the flat surface at a constant speed of 100 mm per second. The force applied by the circular plate is increased until the desired deformation of the portion of the smoking article between the circular plate and the flat surface is achieved. For example, to achieve a 50% deformation, the compressed portion of the smoking article is compressed to a diameter of 50% of the diameter of that portion prior to compression. Similarly, to achieve a 67% deformation, the smoking article is compressed until the compressed portion is reduced to a diameter of 33% of the diameter of that portion prior to compression. The diameter is measured in the direction of compression, which is the direction extending between the flat surface and the circular plate. Once the desired compression has been achieved, the force required to provide that compression is noted as the compressive strength of the filter. The circular plate is then retracted so that the compressive force is removed. The smoking article is left for 30 seconds to expand before any further tests or measurements are performed.

Smoking Test

To simulate the smoking of a smoking article, the smoking article is subjected to a standard smoking test under ISO conditions (35 ml puffs lasting 2 seconds each, every 60 seconds). In the ISO test method, the smoking article is smoked with the ventilation zone fully uncovered.

Capsule Crush Test

To perform a capsule crush test in accordance with the present invention, a smoking article including a breakable capsule is positioned between a lower plate having a diameter of 150 mm and an upper plate having a diameter of 20 mm. The portion of the smoking article housing the breakable capsule is positioned between the two plates such that the plates are centred on the location of the capsule. The smoking article and the capsule are then compressed by moving the upper plate towards the lower plate at a constant speed of 30 mm per minute. The force applied by the upper plate is increased until the capsule breaks, at which point the maximum compressive load applied by the upper plate is recorded as the crush strength of the capsule. The test is terminated when the maximum compressive load is reached and the upper plate is retracted to remove the compressive force from the smoking article. The smoking article is then left for 30 seconds to expand before any further tests or measurements are performed, such as ovality measurements.

The invention will now be further described, by way of example only, with reference to the accompanying drawings in which.

Figure 1:
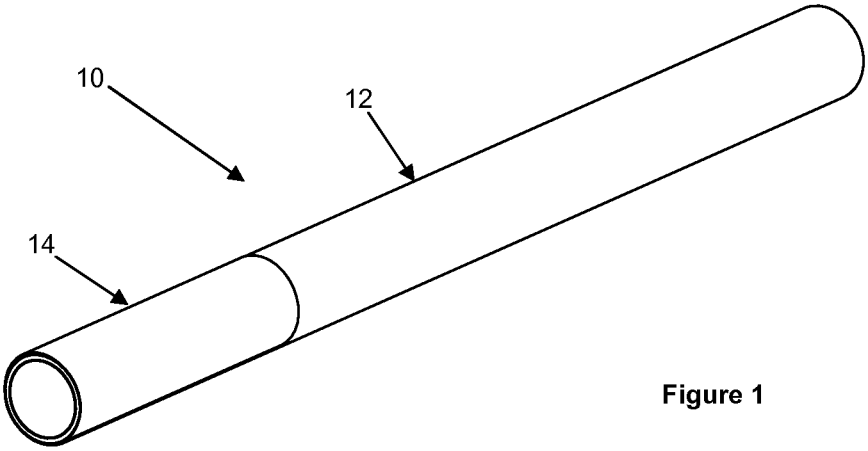
FIG. 1 shows a smoking article in accordance with the present invention.
Figure 2:
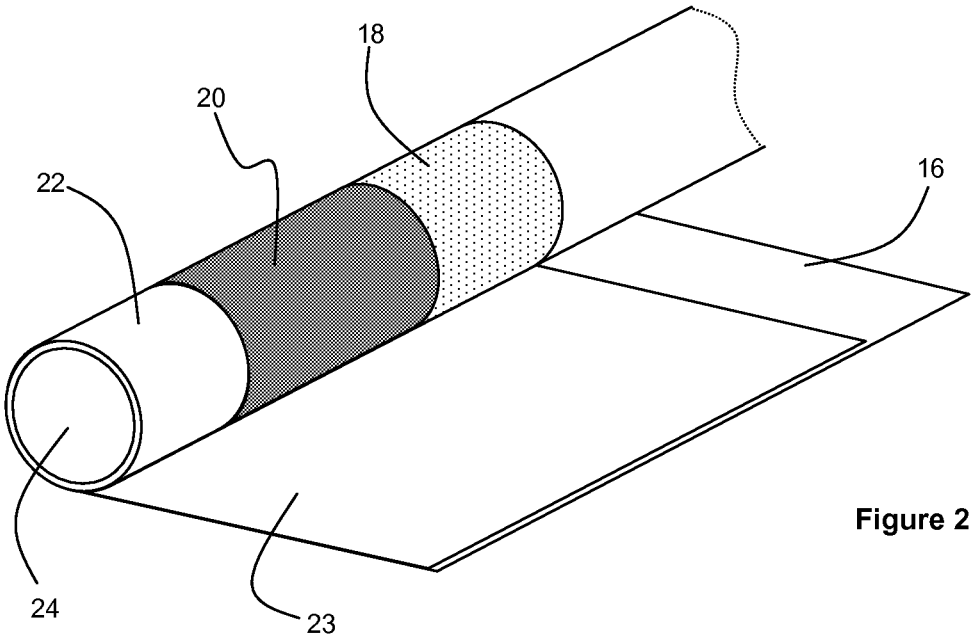
FIG. 2 shows the mouth end of the smoking article of FIG. 1 with the filter unwrapped.

FIGS. 1 and 2 show a filter cigarette 10 in accordance with the present invention. The cigarette 10 comprises a wrapped rod 12 of tobacco cut filler which is attached at one end to an axially aligned filter 14. A tipping wrapper 16 circumscribes the filter 14 and a portion of the wrapped rod 12 of tobacco to join together the two portions of the cigarette 10.

As shown in FIG. 2, the filter 14 comprises a rod end filter segment 18, a flavour containing filter segment 20, and a mouth end hollow tube segment 22. The segments 18, 20 and 22 are circumscribed by a combining plug wrap 23 which connects the three segments to form the filter 14. The combining plug wrap 23 has a basis weight of less than 90 gsm. One or more of the segments 18, 20, 22 may also be wrapped in an individual plug wrap.

The rod end filter segment 18 and the flavour containing filter segment 20 are formed of a suitable filtration material, such as cellulose acetate tow. Furthermore, the flavour containing filter segment 20 comprises a suitable flavourant provided in the form of one or more breakable capsules contained within the flavour containing filter segment 20. The one or more breakable capsules may be ruptured by the consumer when desired by squeezing the flavour containing filter segment 20 between the consumer's fingers.

The mouth end hollow tube segment 22 defines a mouth end cavity 24 in the filter 14 which extends between the downstream end of the flavour containing filter segment 20 and the mouth end edge of the filter 14. The mouth end hollow tube segment 22 may be formed of a plurality of spirally wound paper layers which can further improve the resistance to deformation of the mouth end cavity 24, for example during the rupture of the one or more breakable capsules when present in the flavour containing filter segment 20. The ovality of the tube segment after a 50% deformation of the filter 14 is less than 25%.

Figure 3:
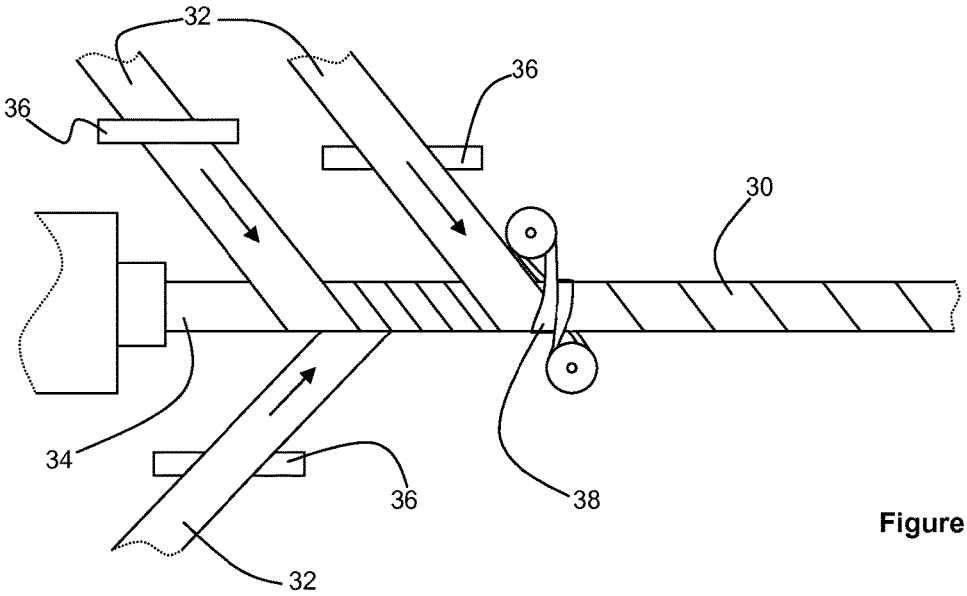
FIG. 3 shows an exemplary method of forming a tubular member for forming hollow tube segments in accordance with the present invention.
Figure 4:
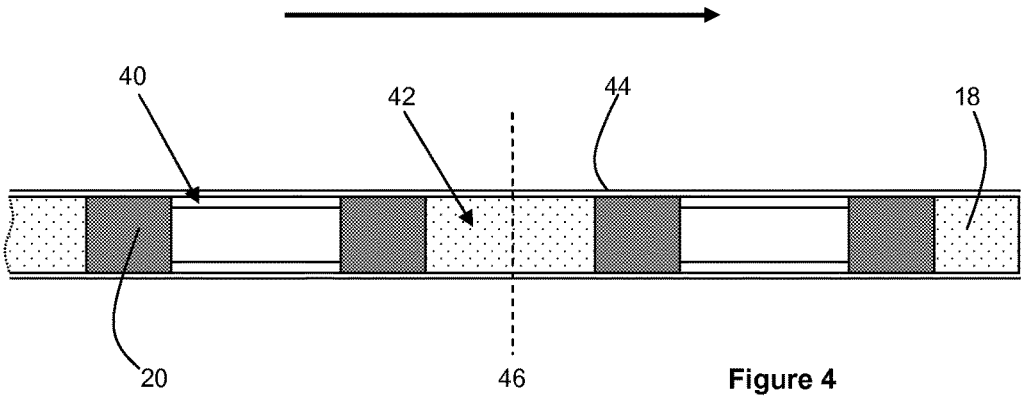
FIG. 4 shows a method of forming a plurality of smoking article filter rods for use in producing smoking articles according to the present invention.

FIG. 3 shows an exemplary method of forming a tube member 30 which can be cut to form a plurality of hollow tube segments for use in forming smoking articles in accordance with the present invention. A plurality of continuous paper plies 32 are spirally wound around a cylindrical mandrel 34 in a staggered, overlapping arrangement. A suitable adhesive may be applied to one or more of the plies 32 using an adhesive bath 36 prior to winding each ply around the mandrel 34. The plies 32 are driven by a rubber belt 38 so that the formed tubular member 30 rotates around the mandrel 34 until it is cut into desired lengths further downstream.

To form a plurality of smoking articles in accordance with the present invention, the process illustrated in FIGS. 4 to 7 can be used. First, a plurality of filter rods is produced according to the process shown in FIG. 4. A substantially continuous array of filter components is formed by providing a plurality of tubular members 40, a plurality of flavour containing filter segments 20 and a plurality of rod end filter members 42. A tubular member 40 is provided between each pair of consecutive rod end filter members 42, and a flavour containing filter segment 20 is provided between each rod end filter member 42 and each tubular member 40. The substantially continuous array of filter components is then wrapped in a continuous sheet of plug wrap 44 to form a wrapped filter array.

To form a plurality of filter rods, a plurality of first cuts 46 are made through at least some of the rod end filter members 42 of the wrapped filter array, each first cut 46 positioned at an intermediate position along the length of the respective rod end filter member 42. The resilience of each tubular member 40 advantageously prevents collapse of the cavities defined therein during the cutting process and subsequent handling of the filter rods and smoking articles incorporating filters manufactured from the filter rods.

Figure 5:
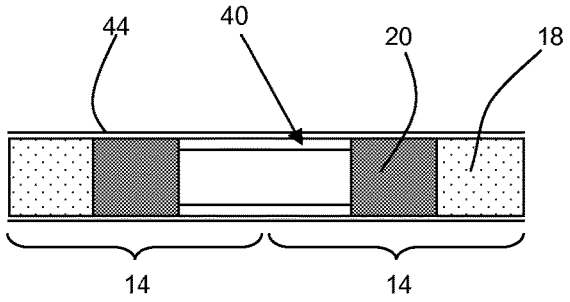
FIG. 5 shows a dual filter rod.

To form a dual filter rod, as shown in FIG. 5, the wrapped filter array is cut through each rod end filter member 42 so as to provide a filter rod having a rod end filter segment 18 at each end, two flavor containing filter segments 20 positioned between the two rod end filter segments 18, and a tubular member 40 positioned between the two flavor containing filter segments 20. The dual filter rod essentially defines two smoking article filters 14 which are joined by a continuous plug wrap 44 and a tubular member 40.

Figure 6:
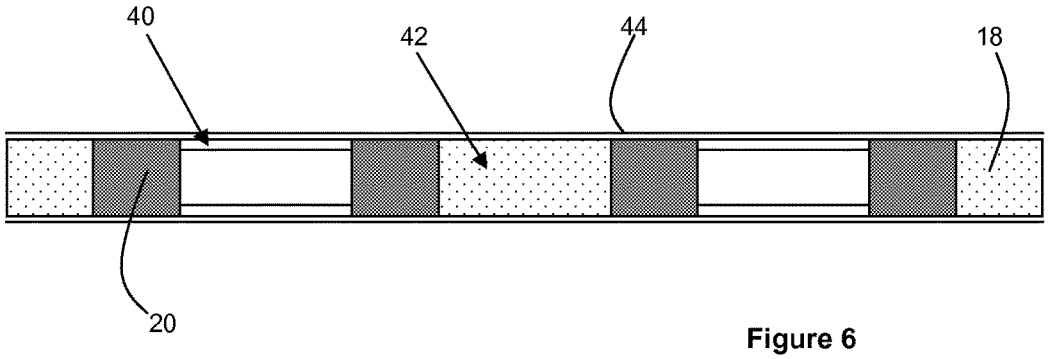
FIG. 6 shows a quad filter rod.

Alternatively, a quad filter rod, as shown in FIG. 6, can be formed by cutting the wrapped filter array through every other filter member 42 so as to provide a filter rod which essentially comprises two joined dual filter rods.

Figure 7:
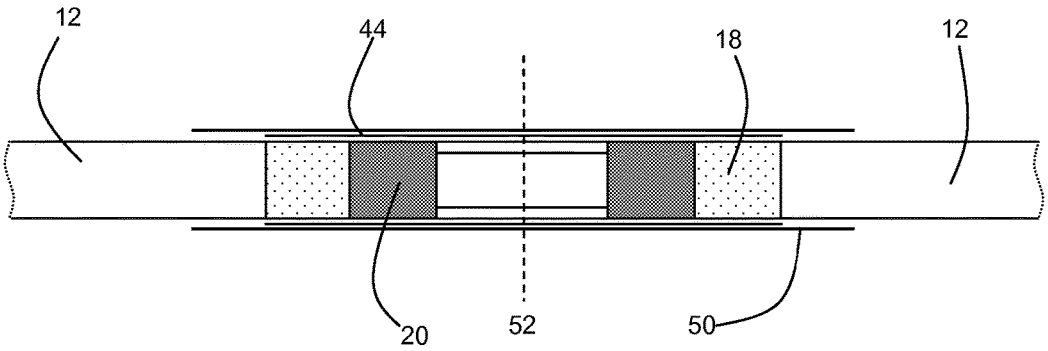
FIG. 7 shows an exemplary method for forming a smoking article using a dual filter rod.

The formed filter rods can be used to form two or more smoking articles. For example, as shown in FIG. 7, a dual filter rod can be used to form two filter cigarettes 10 by placing a tobacco rod 12 in axial alignment with each end of the filter rod. A tipping wrapper 50 is then wrapped around the filter rod and a portion of each tobacco rod 12 adjacent the filter rod. The tipping wrapper 50, the plug wrap 44 and the tubular member 40 are then cut along a cut line 52 to form two filter cigarettes. The resilience of the tubular member 40 prevents collapse or deformation of the mouth end cavities of each cigarette 10 during the cutting process.

To form a plurality of smoking articles using a quad filter rod, the filter rod is first cut through the rod end filter member 42 to form two dual filter rods. The two dual filter rods can then be used to form four smoking articles using the method shown in FIG. 7.

The invention claimed is:

1. A smoking article comprising:

a tobacco rod;

a filter comprising:

a first filter segment comprising one or more breakable capsules, each breakable capsule comprising an outer shell and an inner core containing an additive;

a hollow tube segment downstream of the first filter segment, the hollow tube segment comprising a wall with an inner wall surface defining a cavity at the mouth end of the filter, the hollow tube segment positioned between a downstream end of the first filter segment and the mouth end of the filter; and a plug wrap circumscribing the first filter segment and an outer wall surface of the hollow tube segment, wherein the plug wrap has a basis weight of less than 90 grams per square meter, wherein the wall of the hollow tube segment is formed from a plurality of overlapping paper layers, adjacent paper layers of the wall of the hollow tube segment being adhered together by an intermediate layer of an adhesive; and a tipping wrapper circumscribing the plug wrap and at least a portion of the tobacco rod to connect the filter to the tobacco rod.

2. The smoking article according to claim 1, wherein the ovality of the hollow tube segment after a 50% deformation of the filter is less than 25%.

3. A smoking article according to claim 2 wherein the ovality of the tube segment is less than 25% after a capsule crush test in which a force corresponding to the crush strength of the one or more capsules is applied to the first filter segment.

4. A smoking article according to claim 1 wherein the ovality of the tube segment is less than 25% after a capsule crush test in which a force corresponding to the crush strength of the one or more capsules is applied to the first filter segment.

5. A smoking article according to claim 1, wherein the wall of the hollow tube segment is formed from a plurality of spirally wound paper layers.

6. A smoking article according to claim 1, wherein the difference between the ovality of the tube segment after 50% deformation of the filter and the ovality of the tube segment prior to deformation of the filter is less than 25%.

7. A smoking article according to claim 1, wherein the ovality of the hollow tube segment after a 50% deformation of the filter performed after the smoking article has been subjected to a smoking test is less than 35%.

8. A smoking article according to claim 1 wherein the hollow tube segment comprises a coating layer on an inner surface thereof.

9. A smoking article according to claim 1 wherein the compressive strength of the filter is at least 20 Newtons at 50% compression.

10. A smoking article according to claim 1 wherein the wall of the hollow tube segment has a thickness of between 150 micrometers and 500 micrometers.

11. A smoking article according to claim 1 wherein the hollow tube segment extends at least 2 mm from the downstream end of the first filter segment.

12. A smoking article according to claim 1 further comprising a rod end segment between the first filter segment and the tobacco rod.

13. A smoking article according to claim 1, wherein the tipping wrapper comprises paper having a basis weight between about 20 gsm and 70 gsm.

* * * * *